United States Patent [19]

Jackson

[11] Patent Number: 4,570,580

[45] Date of Patent: Feb. 18, 1986

[54] MULTIPLE PISTON EXPANSION CHAMBER ENGINE

[76] Inventor: Francis W. Jackson, 409 Penwyn Rd., Wynnewood, Pa. 19096

[21] Appl. No.: 688,954

[22] Filed: Dec. 31, 1984

Related U.S. Application Data

[63] Continuation-in-part of Ser. No. 647,842, Sep. 6, 1984, and a continuation-in-part of Ser. No. 326,902, Dec. 2, 1981, Pat. No. 4,489,681.

[51] Int. Cl.[4] ..... F02B 75/18

[52] U.S. Cl. ..... 123/52 B; 123/53 A

[58] Field of Search ..... 123/52 R, 52 B, 51 AA, 123/51 R, 51 A

[56] References Cited

U.S. PATENT DOCUMENTS

| | | | |
|---|---|---|---|
| 1,309,891 | 7/1919 | Griffith | 123/52 B |
| 1,808,083 | 6/1931 | Tibbetts | 123/51 AA |
| 2,153,899 | 4/1939 | Shover | 123/51 AA |
| 2,734,494 | 2/1956 | Waterval | 123/52 B |

FOREIGN PATENT DOCUMENTS

| | | | |
|---|---|---|---|
| 199938 | 10/1958 | Austria | 123/52 B |
| 1029325 | 6/1953 | France | 123/52 B |

*Primary Examiner*—Craig R. Feinberg

[57] ABSTRACT

Multiple expansion chambers are configured to partially expand the combusted charge in the combustion chamber and then to complete the expansion process using a supplemental expansion chamber with chamber isolation designs.

6 Claims, 9 Drawing Figures

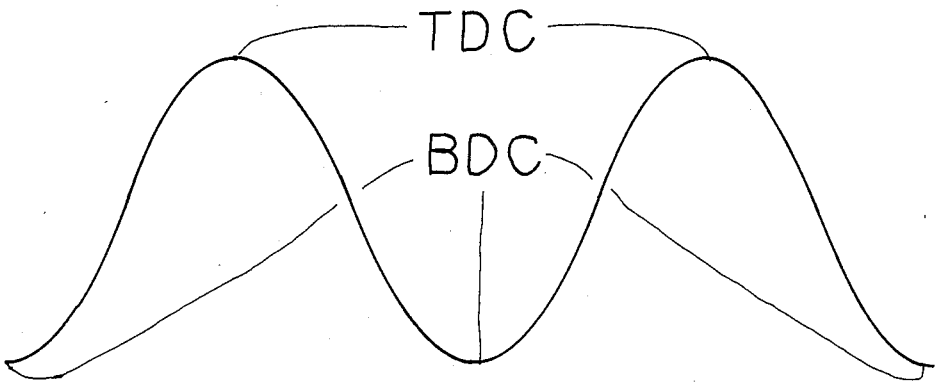
FIG. 2A Center Piston
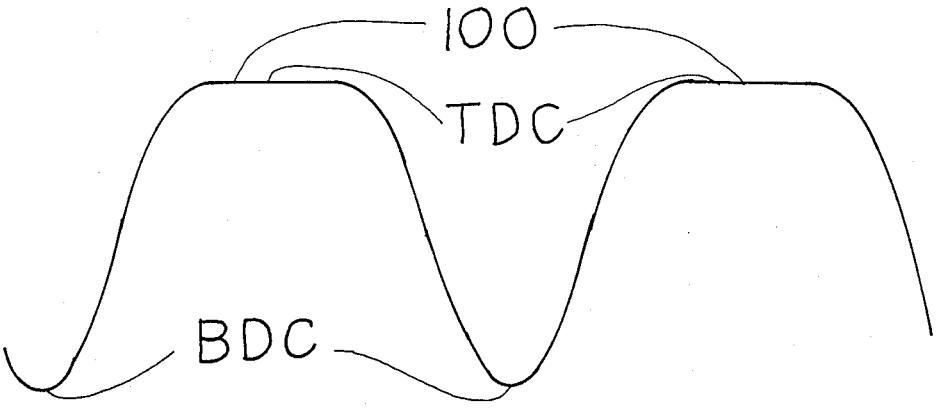
FIG. 2B Annular Piston
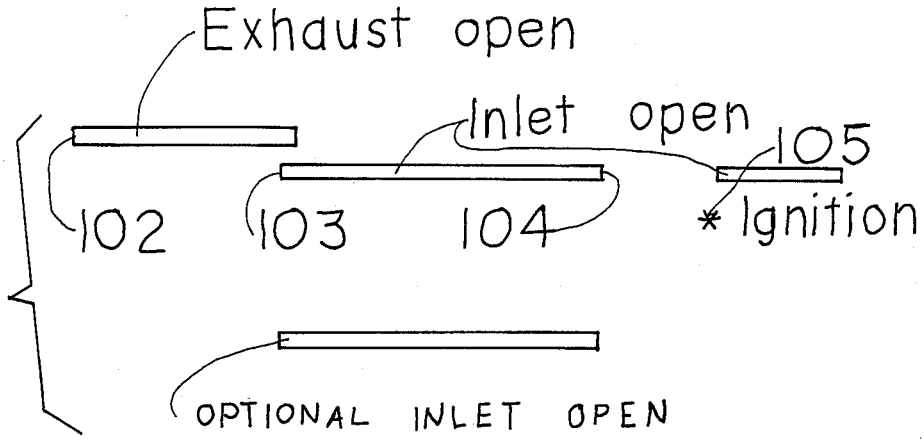
FIG. 2C Valve and Ignition

MULTIPLE PISTON EXPANSION CHAMBER ENGINE

This is a continuation-in-part patent application to patent applications Ser. Nos. 647,842 filed 9/6/84 pending and 326,902 filed 12/2/81, now U.S. Pat. No. 4,489,681.

DESCRIPTION OF PRIOR ART

In prior art the balance of many factors has led to cylinder designs with stroke to bore's around 1. Given this stroke to bore and an average piston speed the engine efficiency and weight for a given cylinder horsepower is pretty well set.

SUMMARY

The use of multiple expansion chambers configured to partially expand the combusted charge in the combustion chamber and then to complete the expansion process using a supplemental expansion chamber with chamber isolation designs that when allowing communication between these chambers accomplish the communication with minimal throttling and minimum added wetted perimiter provides attractive improvements.

The smaller diameter initial chamber allows flame speed to not be as restrictive on stroke to bore. This permits, for flame speed considerations, smaller stroke to bore's to be used. Lower stroke to bore's are not accompanied by significantly increased friction losses as only the combustion chamber sees peak chamber pressure while the auxilary chamber(s) with significantly reduced peak pressure requires smaller bearings. Engine heat transfer losses are down. The net result is increased engine efficiency at reduced weight.

BRIEF DESCRIPTION OF DRAWINGS

FIG. 2A, B and C show the relationship in time for the 4 strokes of the working piston displacement, the auxiliary piston displacement, exhaust valve open, inlet valve(s) open and ignition.

FIG. 1 shows the invention in a 4 stroke spark ignition engine application. Center reciprocating piston 10 with piston rings 11 and oil ring 12 sealing between said piston 10 and cylinderical wall 13 in which piston 10 moves as it is driven by rotating crank 14 through rod 15 and wrist pin 16. Rod 15 connected to wrist pin 17 through bearing 17 and to crank 14 through bearing 18. Rotating crank 14 is held by main bearing 38. Annular piston 19, with piston rings 20 and oil ring 21 sealing the outer circumference of auxiliary piston 19 and the outer cylinder wall 22 in which auxiliary piston 19 moves as identical displacement cams 23 rotating as crank 14 rotates and with push cam follows bearings 24 and pull cam follows bearings 32 pushing and pulling cam follow rods 26. Said cam follower rods constrained in direction by bearing 27 sliding in bearing housing 28. As the two cam follower rods act in unison and, through wrist pin bearing 29 and wrist pins 30, reciprocate auxiliary piston 19 and at TDC auxiliary mating surface 31 of auxiliary piston 19 seals against the mating surface in the engine head 34. Rotating valve 33 rotating in head 34 commuting carbureated inlet mixture during injestion to the chamber 35 above the auxiliary piston 19 closing the port to chamber 38 during the compression and expansion strokes and exposing the chamber 35 to the exhaust manifold during exhaust. At about the time inlet valve 539 closes spark plug (not shown) ignites the combustable mixture above the working piston. During the time auxiliary piston 19 is sealed against the chamber head vent passage 36 is open, this vents the pressurized charge trapped above the auxiliary piston back to inlet supply. An additional and optional inlet valve 37 above the working piston is shown and improves the ingestion process.

FIGS. 2A, B and C present the displacements of the circular and auxiliary pistons, the exhaust and inlet openings and ignition timing for the configuration defined in FIG. 1, during the 2 revolutions of a 4 stroke SI engine cycle. FIG. 2A deplicts the displacement of the center round piston as it moves between TDC and BDC. FIG. 2B deplicts the auxiliary piston motion with dwells at TDC 100. FIG. 3C shows that the exhaust port uncovers as the auxiliary piston approaches BDC 102, inlet port opens 103 just prior to the minimum volume condition of the combined chambers above both pistons, with the exhaust closing immediately after. This condition continuing until the auxiliary piston is past BDC 104. Ignition 105 occurs just prior to the sealing of the auxiliary piston and the head. Said auxiliary piston and head seal remaining sealed 100 until partial expansion of the charge by the center piston, then at an angle of between 20 and 180 degrees of crank rotation after TDC of the center piston the cam moves the auxiliary piston away from the head breaking the seal and permiting combustion products to flow into the chamber above the auxiliary piston and both pistons now provide expansion.

FIG. 3 shows the invention using cylinderical pistons in an opposed configuration. Reciprocating piston 201 driven by rod 202 from conventional crank (not shown). Said piston 201 being connected to rod 202 through wrist pin 203 via bearing 204. Piston 201 is reciprocating (see FIG. 2A) in cylinder wall 205 and sealed by pressure rings 206 and oil seal rings 207. Piston 208 is cam driven (to FIG. 1 auxiliary piston profile) through cam followers 209 connected to piston 208 via wrist pin 210 and bearing 211. Piston 208 motion is as shown in FIG. 2B. Piston 201 motion is as shown in FIG. 2A. The vent function described with FIG. 1 is performed by the inlet valve in this configuration.

FIG. 4 shows an alternative valve arrangement detail where the valves are located outside the outer diameter of the auxiliary piston 300. Inlet valve 301 sealing inlet manifold 302 to the chamber above the auxiliary piston 303. The valve 301 has cylinderical barrel 304 sliding in cylinderical wall 305 sealed by rings 306 thereby minimizing the chamber volume when the auxiliary piston is at TDC. A valve for exhaust is also similarly configured at a different location around the chamber. Additionally to provide adequate valve area multiple inlet and/or exhaust valves can be employed.

FIG. 5 shows a variation to FIG. 1 when the tapered raised edge of the seal 400 is attached to the head 401 instead of the auxiliary piston 402 enabling improved cooling of this protrusion.

Figure 6:
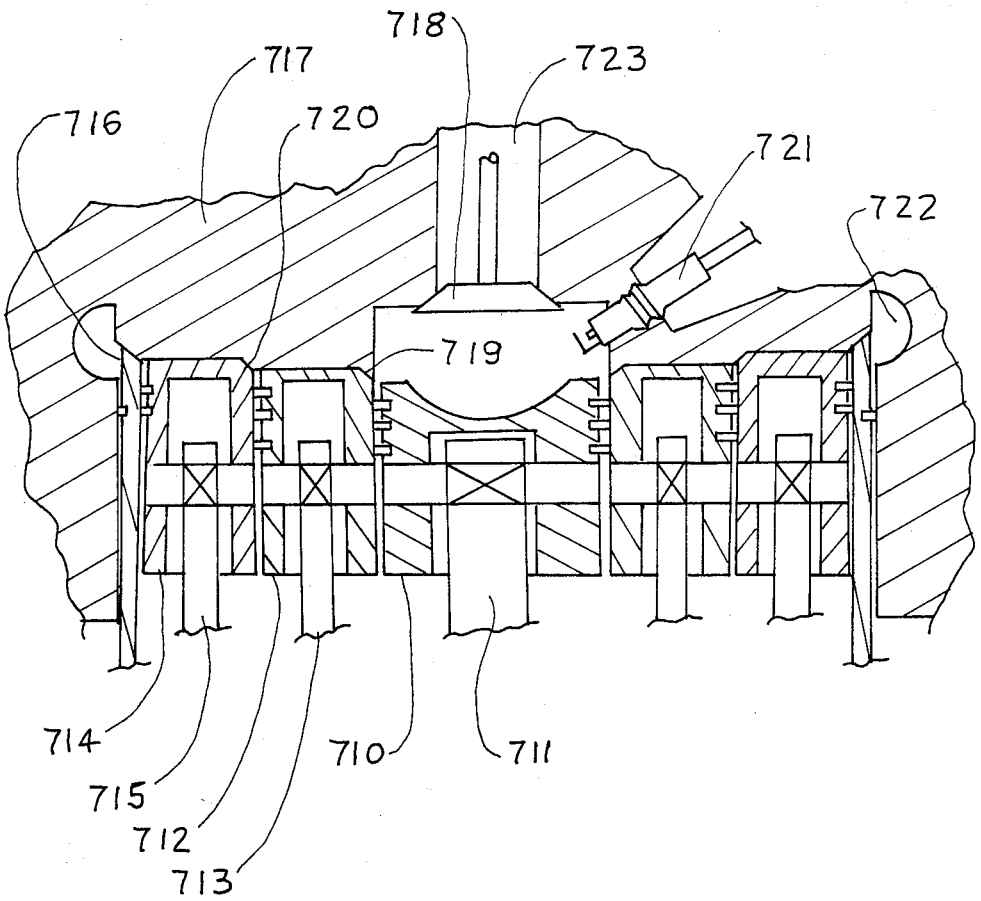
FIG. 6 shows a plurality of auxiliary pistons configuration.

FIG. 6 shows the invention with multiple auxiliary pistons in a 4 stroke engine application. Center piston 710 driven by crank 711 used in a conventional rotating crank engine design while inner piston 712 driven by cam motion follower 713, outer auxiliary piston 714 driven by cam motion follower 718 and annual exhaust valve 716 driven by cam motion follower (not shown). The operation is as follows as exhaust valve 716 is closing and with auxiliary pistons 710 and 712 dwelling while sealed with the head 717 and the center piston 710 approaching TDC, inlet valve 718 starts to open. Then piston 710 reaches TDC and withdraws from the engine head 717 and air is ingested, later pistons 710 and 712 also withdraw to increase the ingestion process. After BDC of pistons the inlet valve 718 closes and before TDC of center piston 710 auxiliary pistons 712 and 714 bottom out on head 717 and seal on thier respective sealing surfaces 719 and 720 and spark plug 721 ignites the compressed charge and combustion takes place. Center piston 710 passes through TDC and when it has partialy expanded the combusted products and with center piston 710 between 20 and 180 degrees of crank rotation after its TDC the inner auxiliary piston 712 moves away from the head and then between about the time auxiliary piston 712 moves away and 90 degrees after auxilliary piston 712 moved away from the head auxiliary piston 714 moves away and all jointly expand the charge. Next as fullest chamber expansion is approached the exhaust valve 716 opens and after fullest expansion the three pistons force the exhaust gas into exhaust passage 722.

Figure 1:
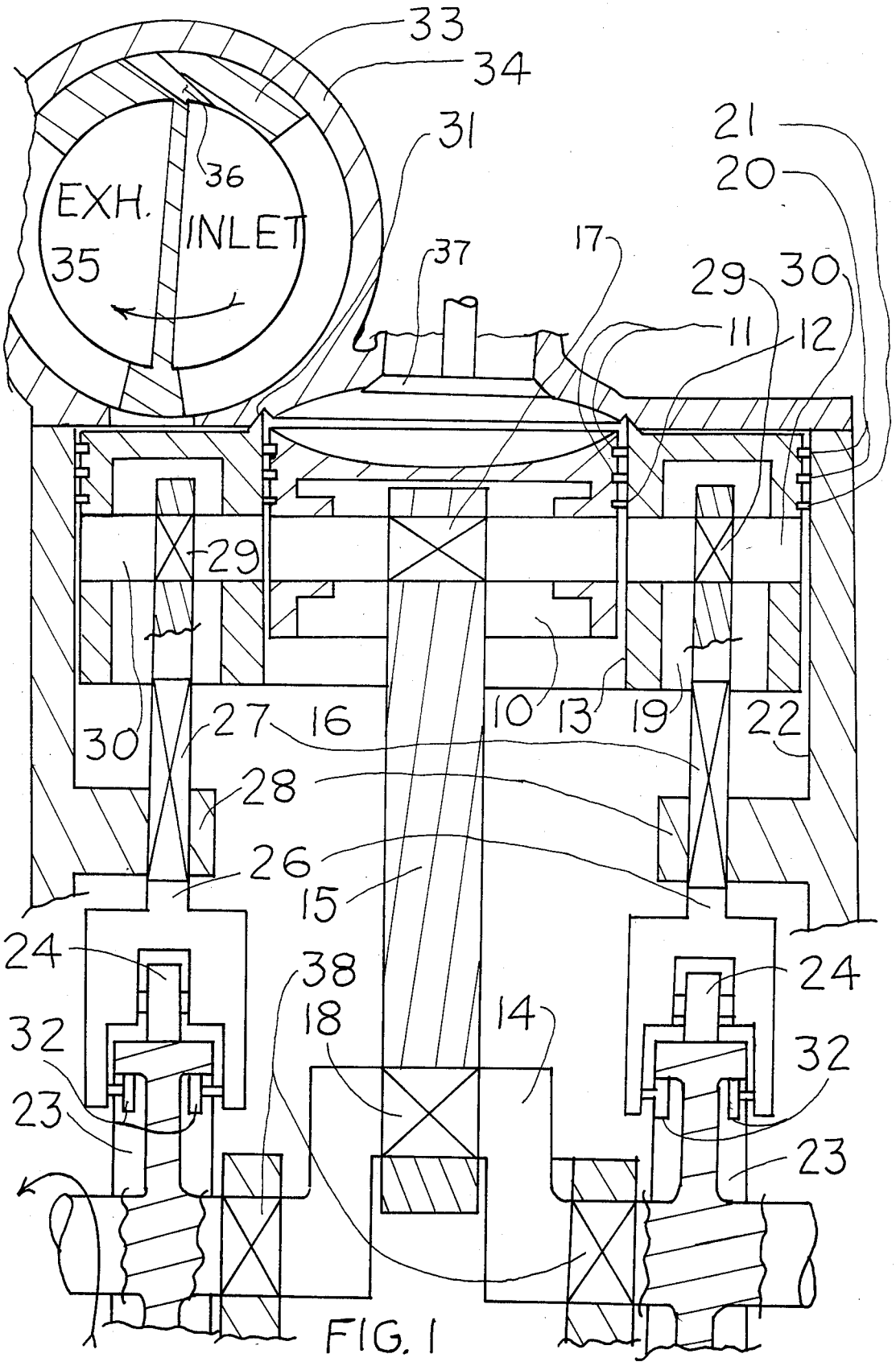
FIG. 1 is a sectional view of one form of the engine.
Figure 3:
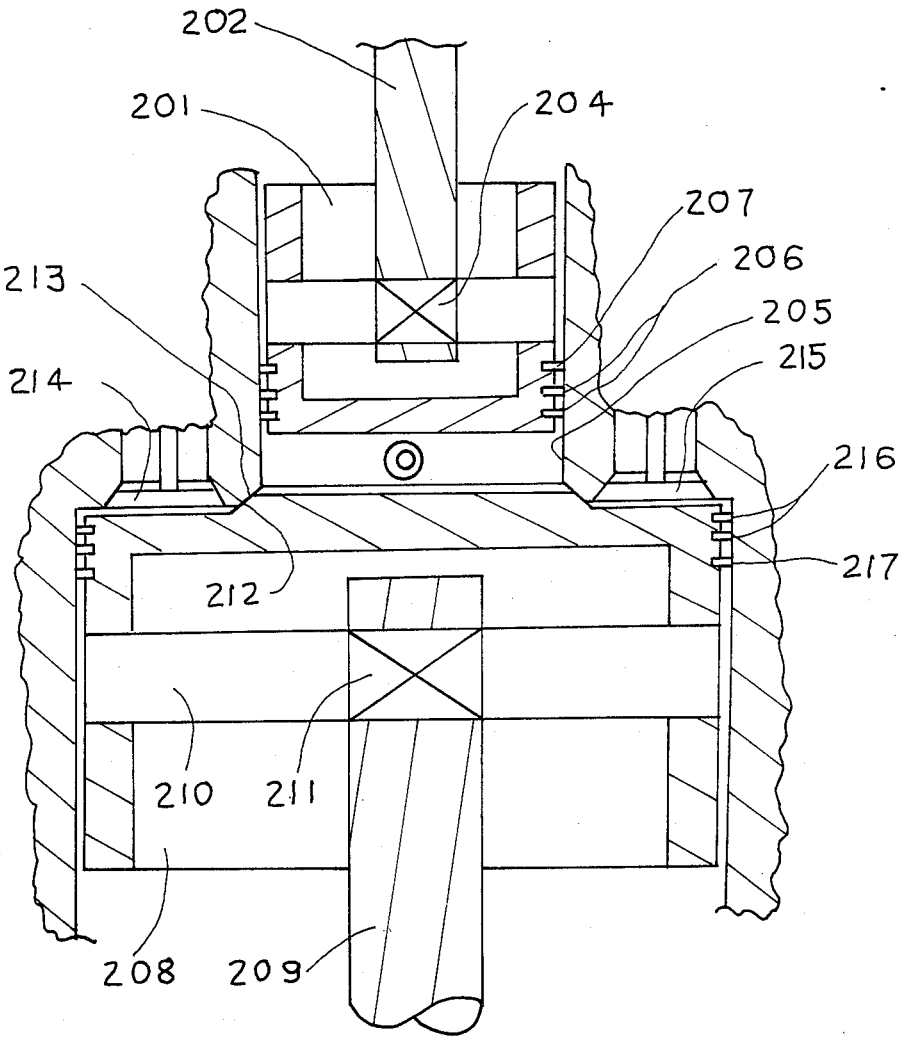
FIG. 3 is a sectional view of another form of the engine.
Figure 4:
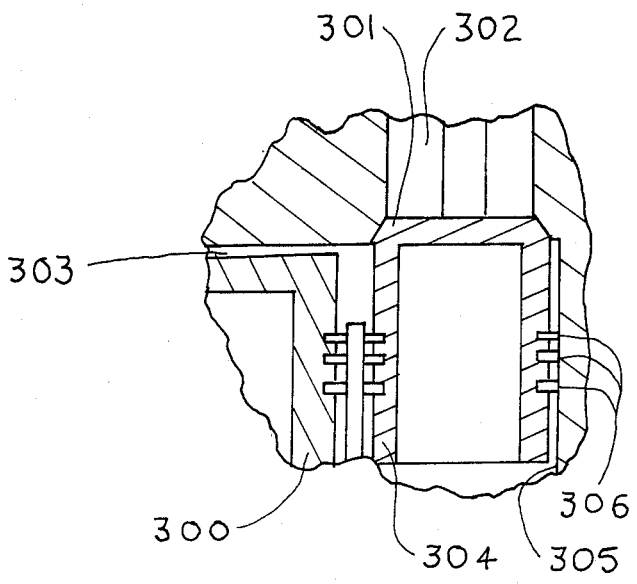
FIG. 4 is a sectional view employing an alternative valve arrangement to minimize entrapped charge above the auxiliary piston.
Figure 5:
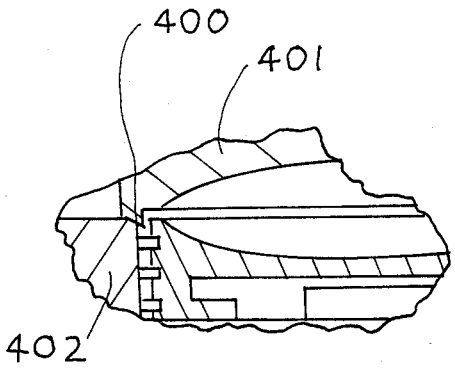
FIG. 5 is the same form of engine as FIG. 1 but with a modified seal.
Figure 7:
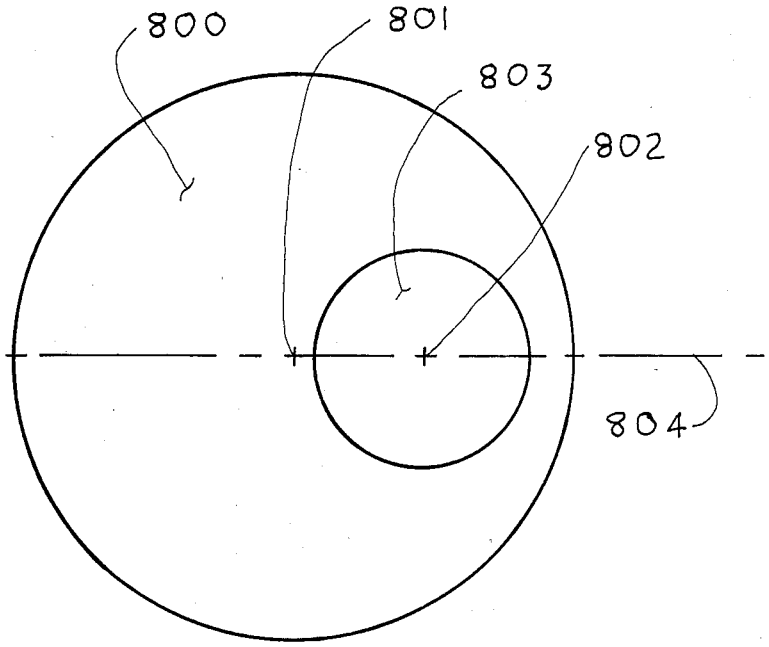
FIG. 7 shows an off center piston arrangement.

FIG. 7 shows auxiliary piston 800 with its center of pressure 801 and working piston 802 with its center of pressure 803 displaced along the crank axis 804 from said auxiliary piston center of pressure 801. Displacing the center of pressures seperates the location of the force supporting elements(crank,cam follower) allowing a single element to support the auxiliary piston as oppossed to two as shown in FIG. 1 for a balanced support. In this arrangement the working piston will impart a twisting force on the auxiliary piston. This necessitates a bearing to resist this force or as an alternative twin counter rotating cranks to provide for symetric loading such that twisting forces are essentially eliminated.

While the above discussions used a conventional inlet supply pressure a pressurized supply(turbocharger, etc.) is applicable and while not required would improve aspiration and operate at higher levels of charge.

What is claimed is:

1. An internal combustion engine comprising a cylinder with an auxiliary piston reciprocating in the cylinder, a working piston reciprocating within the auxiliary piston, an auxiliary chamber above said auxiliary piston, a combustion chamber above said working piston and means providing a dwell of said auxiliary piston at TDC starting from when the working piston is between 40 degrees before to about TDC and on passing TDC entering an expansion stroke; said auxiliary piston remaining at TDC until when the working piston expansion stroke is underway and at a point where said working piston is between 20 and 160 degrees past TDC during said expansion stroke at which said point said auxiliary piston leaves TDC and moves toward BDC; means controlling communication of said combustion chamber with said auxiliary chamber to prevent communication of combusted products from said combustion chamber above said working piston to said chamber above said auxiliary piston while said auxiliary piston is at TDC and to permit communication only during said working piston expansion stroke continuing past said point between 20 and 160 degrees past TDC and a following exhaust stroke of said working piston so as to utilize energy of expansion from said auxiliary piston as it expands until said working piston has passed through BDC and returns to about TDC during said exhaust stroke of said working piston.

2. An internal combustion engine according to claim 1: wherein said controlling means comprises a sealing surface on said auxiliary piston adjacent said working piston.

3. An internal combustion engine according to claim 1: wherein said controlling means comprises a circular sealing surface on an upper surface of said auxiliary piston adjacent said working piston.

4. An internal combustion engine according to claim 1: wherein the chamber above the auxiliary piston is vented back to inlet supply during the time interval of late compression and early expansion of the working piston while the auxiliary piston chamber is isolated from the working piston chamber.

5. An internal combustion engine according to claim 2: wherein the chamber above the auxiliary piston is vented back to inlet supply during the time interval of late compression and early expansion of the working piston while the auxiliary piston chamber is isolated from the working piston chamber.

6. An internal combustion engine according to claim 3: wherein the chamber above the auxiliary piston is vented back to inlet supply during the time interval of late compression and early expansion of the working piston while the auxiliary piston chamber is isolated from the working piston chamber.

* * * * *